United States Patent [19]

Zerle et al.

[11] 4,329,838

[45] May 18, 1982

[54] METHOD AND APPARATUS FOR DETWISTING CLOTH

[75] Inventors: Ludwig Zerle, Mering; Heinz Schmidt, Stadtbergen, both of Fed. Rep. of Germany

[73] Assignee: Erhardt & Leimer KG, Augsburg, Fed. Rep. of Germany

[21] Appl. No.: 134,268

[22] Filed: Mar. 26, 1980

[30] Foreign Application Priority Data

Mar. 28, 1979 [DE] Fed. Rep. of Germany ..... 2912340

[51] Int. Cl.[3] ..... D06C 3/06; D06C 29/00; G01L 5/00

[52] U.S. Cl. ..... 57/1 UN; 8/151; 57/31

[58] Field of Search ..... 57/1 R, 1 UN, 2.3, 2.5, 57/31; 8/151, 151.1; 26/1, 74, 99

[56] References Cited

U.S. PATENT DOCUMENTS

| | | | |
|---|---|---|---|
| 2,117,603 | 5/1938 | Dungler | 57/1 UN |
| 2,248,962 | 7/1941 | Cook | 57/1 UN |
| 2,759,324 | 8/1956 | Dean | 57/1 UN |
| 2,836,012 | 5/1958 | Moorhouse et al. | 57/1 UN |
| 3,533,144 | 10/1970 | Jaffe et al. | 57/1 UN X |
| 3,693,336 | 9/1972 | Bassani | 57/1 UN |
| 3,813,862 | 6/1974 | Tsuchida | 57/1 UN |
| 4,106,004 | 8/1978 | Kuroda | 57/1 UN X |

*Primary Examiner*—John Petrakes
*Attorney, Agent, or Firm*—Karl F. Ross

[57] ABSTRACT

A twisted textile web is detwisted by continuously withdrawing the web from a supply and passing the web longitudinally along a path and over a curved deflecting surface formed by a roller that deflects the web and divides the path into an upstream leg and a downstream leg that are out of alignment with each other. The deflecting surface can pivot about a pivot axis which passes through a pivot located to the upstream side of a straight line passing through the center of curvature of the deflecting surface and angularly equispaced between the legs. In a central position of the deflecting surface the two legs, the surface, and the pivot are all coplanar so that a twist in the web will pivotally deflect the surface in a direction depending on the direction of twist. The extent of pivoting is detected and the web is detwisted in the upstream leg in response to the detected pivoting of the surface. It is also possible to rotate the entire supply synchronously with the detwisting device to prevent a twist from being added to the web with the system according to this invention.

10 Claims, 5 Drawing Figures

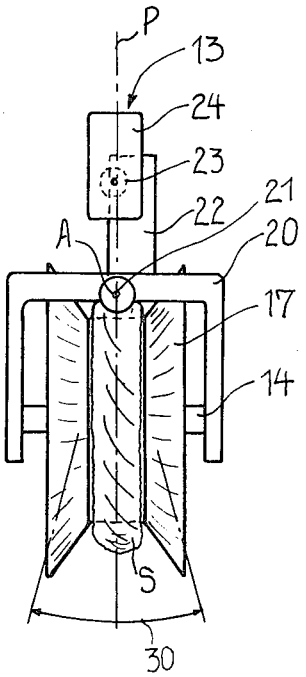
FIG 3
FIG 4
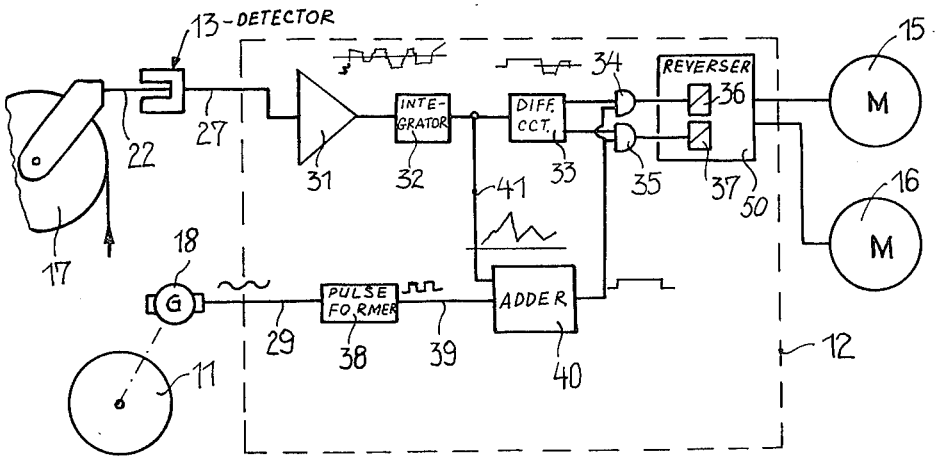

METHOD AND APPARATUS FOR DETWISTING CLOTH

FIELD OF THE INVENTION

The present invention relates to a method of and an apparatus for detwisting cloth. More particularly this invention concerns a system usable in a textile-treatment operation wherein a textile web that is bunched up and twisted together must be flattened out.

BACKGROUND OF THE INVENTION

Certain textile-treatment operations, such as dyeing, leave the textile web being treated in a bunched-up and twisted together condition. Obviously marketing or further treating the web requires it to be smoothed out and flattened, so that some sort of automatic device must normally be provided which can draw the cloth out of a bin or other such container and flatten it out while eliminating the twist in it. Such an apparatus normally draws the cloth along a treatment path past a twist-sensing location. A spreader and flattener is provided upstream of the sensing location and a detwisting device is provided downstream of this location. In accordance with the twist sensed at the location the detwister twists the fabric in the opposite direction so as to eliminate its twist so that the following flattener and smoother can operate effectively on the cloth.

In German published patent application No. 2,315,892 (whose equivalent is U.S. Pat. No. 3,813,862 of June 4, 1974) the strand or web is passed over a fixed roller rotatable about a horizontal axis. The sensing location is immediately downstream of this roller and the detwisting device is upstream of this roller. At the sensing location the strand is pressed by means of a pressure plate into a slitted guide channel in whose slot a brush-type sensor roller engages from outside. This sensor roller is driven in a direction opposite the transport direction of the strand and is longitudinally displaceable along its drive shaft. Thus the bristles of this sensor roller engage the surface of the web, and will be urged to one side or the other in accordance with any twist in the web. End switches acted on by this sensor roller serve to operate the detwisting device to eliminate the twist upstream of the deflecting roller.

Such a system requires considerable tension in the strand for it to function, and requires that the pressure plate be urged with considerable force against the strand. Thus a delicate textile can easily be damaged by this system. Furthermore the detwister frequently adds twist to the textile web, in particular as such a web is normally most severely twisted at its free end, so that in overcoming this twist the detwister normally imparts a twist to the section upstream so that the entire web will be given this twist as it passes along the section.

In U.S. Pat. No. 3,693,336 such an apparatus is shown wherein the rope-like bundle formed by the cloth is passed through a rotatable tube guide whose entrance end is fitted with a plurality of smoothly curved protuberances which extend radially inwardly so as to contact the rope-like bundle tightly. Such an arrangement acts as a detwister, but requires that the textile be engaged with considerable force so as to detwist it. Furthermore, much as in the above-described German patent publication, the detwisting operation itself may add undesirable twist to the upstream portion of the strand.

From U.S. Pat. No. 2,759,324 an arrangement is known wherein the twisted strand is pressed flat between sensing rollers which extend perpendicular to the transport direction of the strand and which are laterally slidable on their respective axles. The extend of slide of the sensing rollers controls the rotary drive for the detwisting apparatus. Once again this apparatus relies on subjecting the arrangement at the sensing device to considerable mechanical manipulation so that a delicate cloth may be damaged. Furthermore, in order to draw the strand or web through these pinch rollers it is necessary to pull the strand or web with considerable force, once again risking damage to the web.

In German published application No. 2,216,753 it is known to form a so-called hot trail on the twisted strand. This trail is sensed and in turn operates the detwisting device. Such an arrangement is extremely complex and cannot be applied to certain types of textiles.

OBJECTS OF THE INVENTION

It is therefore an object of the present invention to provide an improved method of and apparatus for detwisting a cloth.

Another object is to provide an improved detwisting system which operates very gently so that it can be used with even relatively fragile textile webs.

Another object is to provide such an apparatus and method which allow a web to be detwisted without introducing any extra twist into it in the detwisting operation.

SUMMARY OF THE INVENTION

These objects are attained in part according to the instant invention by passing the web over a curved deflecting surface that divides the path of the web into an upstream leg and a downstream leg. According to this invention this curved surface is mounted for pivoting about an eccentric pivot axis that passes through a pivot located to the upstream side of the deflecting surface. More particularly the deflecting surface, when a completely untwisted strand is passed over it, defines a center position in which it lies in a plane including the upstream and downstream legs. The pivot also lies in this plane in the center position, to the upstream side of a straight line that passes through the center of curvature of the deflecting surface and that is angularly equispaced between the upstream and downstream legs. Thus any twist in the web will cause the deflecting surface to pivot about its axis in a direction depending on the direction of twist, and to an extent depending on the extent of the twist. A detwisting device is provided in the upstream leg and is linked via control means to a sensor that detects the angular position of the deflecting surface so that the detwisting device can act on the web in this upstream leg and automatically remove the twist from the web.

With the system according to the instant invention it is therefore possible to read the twist in the web while exerting only a minor longitudinal force on the web. Supporting the deflecting surface for rotation on a pivot to the upstream side of the deflecting surface ensures that the modest longitudinal tension in the web, which will have the inherent effect of exerting torque on whatever guide structure it encounters, will allow the system to determine the presence, extent and direction of twist with considerable accuracy.

According to further features of this invention the supply itself is mounted for rotation about an axis which extends along, that is which may coincide with or be generally parallel to the path at the supply. Drive means is connected to this turntable carrying the supply of the web to rotate it synchronously with the detwisting device so that as the upstream leg of the web is twisted in one direction to remove a sensed twist from it, the supply will be synchronously rotated, that is in the same direction and through the same angular displacement. This type of arrangement ensures that a twist will not be added to a web during the detwisting operation. Furthermore, this system is extremely advantageous because the starting end of the web is normally much more greatly twisted that the central portions of it, so that although considerable self-adjustment is necessary during the initial stages, such adjustment becomes less necessary unless, of course, the initial adjustments have imparted a great deal of twist to the web.

According to further features of this invention the deflecting surface is the periphery of a deflecting roller rotatable about a horizontal axis constituting the center of curvature of the surface and extending perpendicular to the plane in which the surface lies in the above-discussed center position. Such use of a roller further decreases the effects of friction on the web, while in no way lessening the ability of the arrangement to detect the twist in the web.

According to yet another feature of this invention the detwisting device according to this invention is a pair of three rollers staggered to opposite sides of the path and serving to pinch the web at two locations. These three rollers are themselves mounted on a detwisting support which can be rotated about the axis of the upstream leg by a motor operated by the control means.

According to further features of this invention a stabilizing roller is provided between the downstream end of the sinuous path through the detwisting rollers and the deflecting rollers so as to stabilize the entire web and prevent it from vibrating on the deflecting roller. This stabilizing roller and the various detwisting rollers can all be mounted on on a subassembly that can be completely separately removable from the machine for servicing or replacement if desired.

According to another feature of this invention the sensing device is constituted by a metal plate carried on the support and engaged between a sensor of the type that does not have to physically touch the plate. Thus this sensor could be magnetic or optical, and would generate a signal having a medium level at the center position, a relatively low level at one end position and a relatively high level at the other end position.

In accordance with yet another feature of this invention this signal is used to operate either of a pair of reversing relays whose operation is also controlled by an adder which takes into account the transport speed of the web and the extent of deflection as established by integrating the deflection signal. Thus in the event that the deflection is relatively great and the speed is relatively great the appropriate reversing switch will operate the motor that rotates the twisting apparatus for a relatively long period of time.

BRIEF DESCRIPTION OF THE DRAWING

FIG. 3 is a view taken in the direction of arrow III of FIG. 2;

FIG. 4 is a schematic diagram illustrating the control means according to this invention.

SPECIFIC DESCRIPTION

Figure 1:
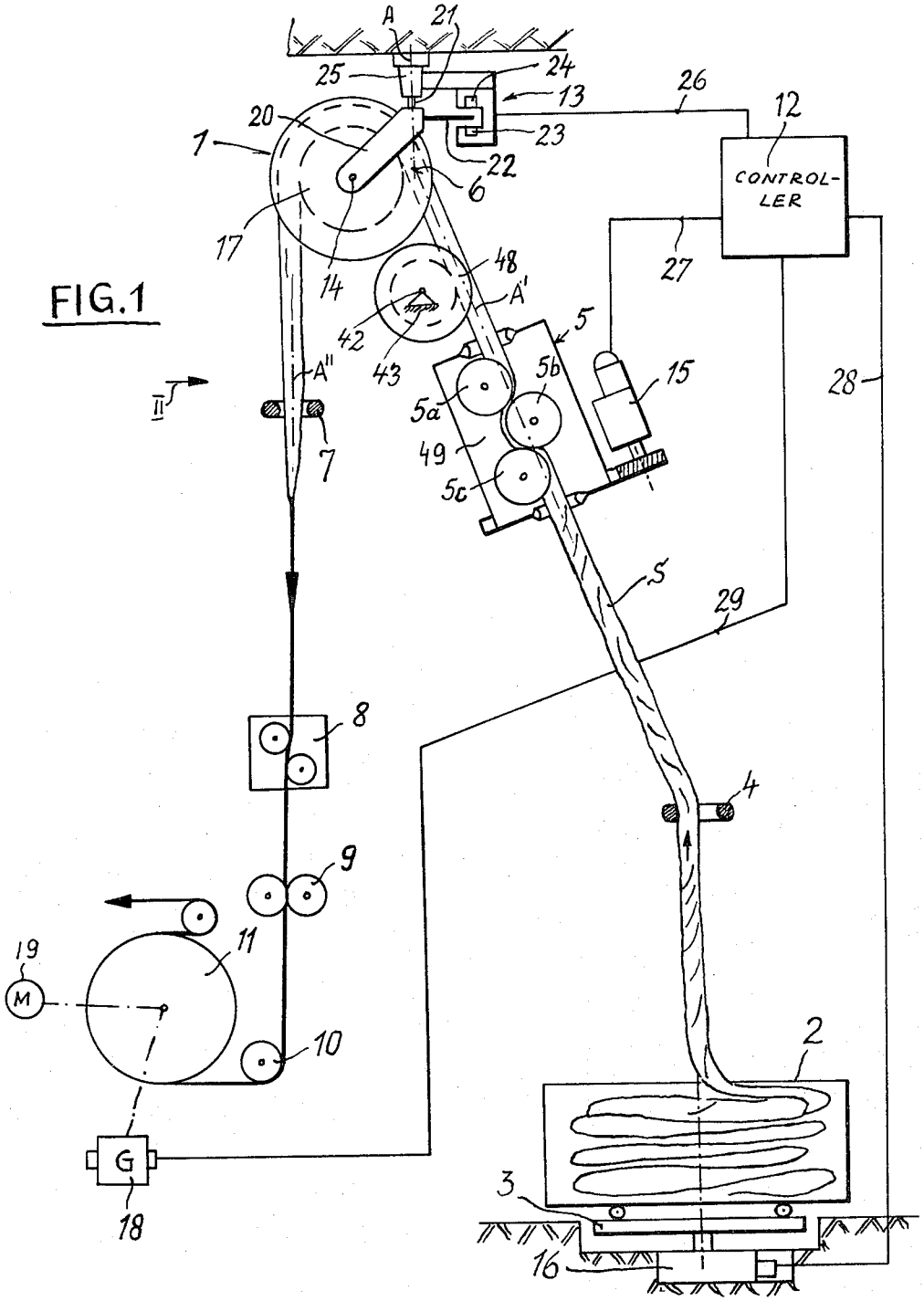
FIG. 1 is a side partly schematic view of the system according to this invention.

As seen in FIG. 1 the apparatus according to this invention has a supply or container 2 holding a rope-like bundle or strand S on a turntable 3 for rotation about an upright axis passing through an upstream guide eye 4. Thereafter the strand S passes through a detwisting device 5, over a stabilizing roller 48, over a deflector 1, and through a downstream guide eye 7. Downstream of this eye 7 the strand S is fanned out as seen in FIG. 2 by a pair of spreader rollers 8, then passes between a pair of guides 9 to a deflecting roller 10 and a main pulling roller 11 that is driven by a motor 19 and that serves to pull the strand S along the generally V-shaped path having its apex at the deflector 1.

The detwisting apparatus 5 according to this invention may be constituted as shown in FIG. 1 by three staggered rollers 5*a*, 5*b* and 5*c* that flank the axis A′ of the upstream leg of the path followed by the strand. These rollers 5*a*–5*c* lightly pinch the strand S. They are mounted on a support plate 49 which is rotatable about this axis A′ by means of a motor 15.

Figure 5:
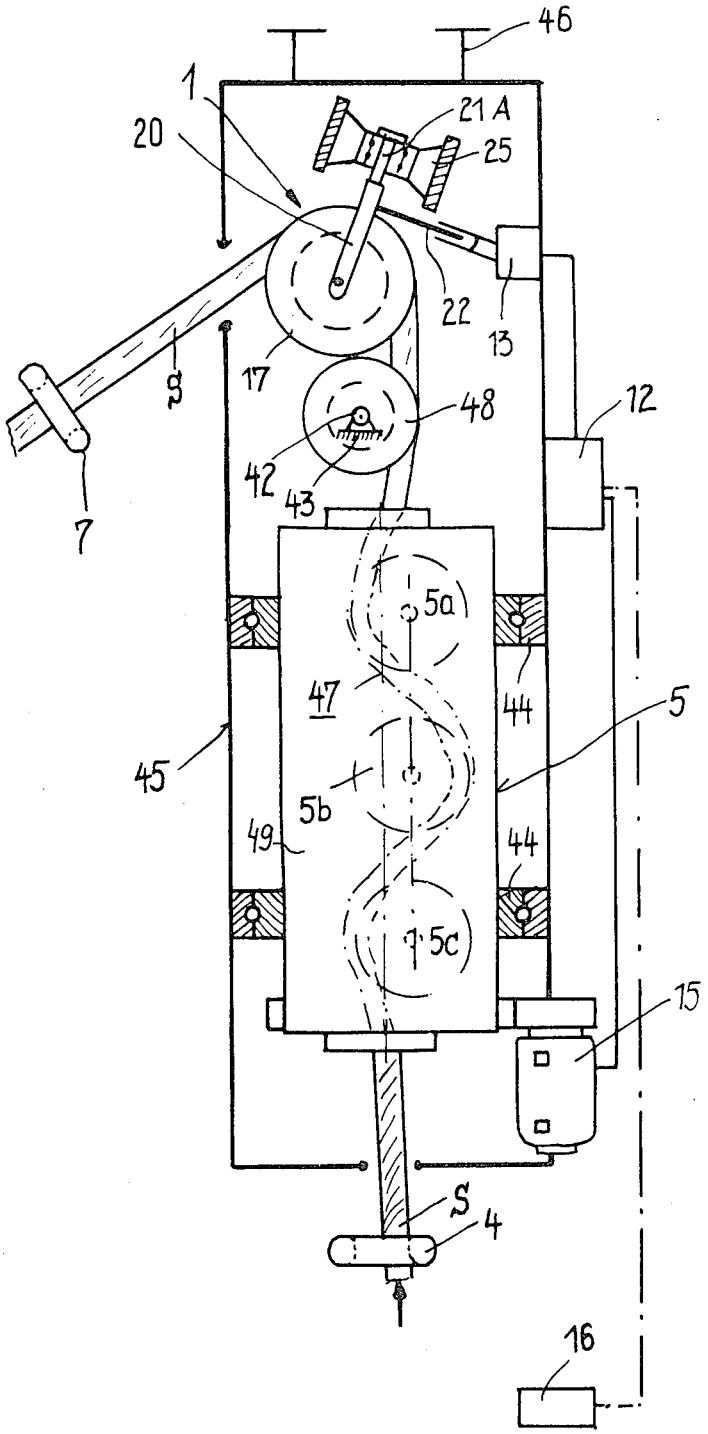
FIG. 5 is a large-scale partly schematic view illustrating an alternative detail of the system according to this invention.

It is also possible as shown in FIG. 5 to mount the plate 49 via bearings 44 on a support plate 45 secured by mounts 46 to a fixed support, but arranged removably so that the entire assembly can be taken off for servicing or repair. The plate 45 also carries the motor 15 and carries a bearing 43 for the axle 42 of the stabilizing roller 48. In addition the plate 45 carries the deflector 1. FIG. 5 also shows how the three rollers 5*a*–5*c* can be mounted in line with one another to cause the strand S to follow a rather sinuous path 47 at the detwisting device 45.

Figure 2:
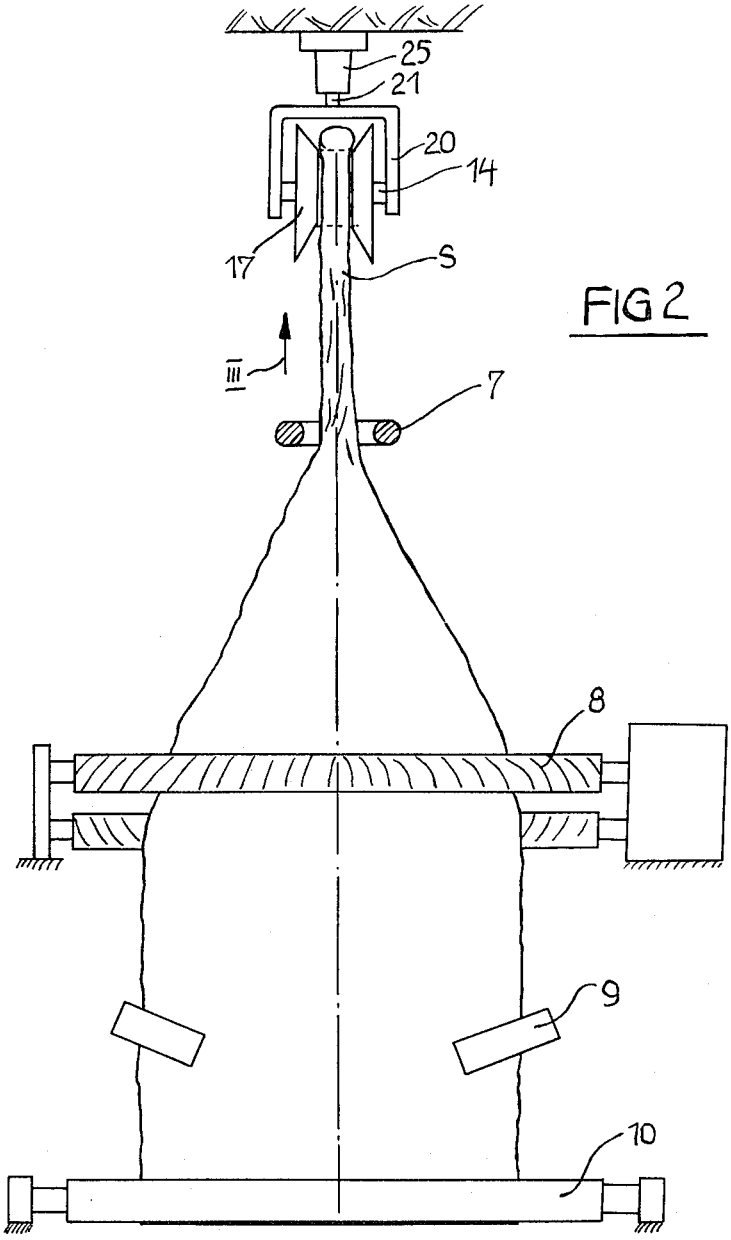
FIG. 2 is a view taken in the direction of arrow II of FIG. 1.

As also shown in FIGS. 2 and 3 the deflector constitutes a wheel 17 formed generally as a V-belt pulley mounted on an axle 14 defining a horizontal axis and carried on a fork 20 itself carried on a vertical axle 21 defining a vertical axis A and received in a mount 25 for pivoting of the entire wheel 17 about the axis A. The fork 20 carries a metal plate 22 engageable in a detector or sensor 13 between a light source 23 and a photocell 24. Instead of the light source and photocell 23 and 24 it would also be possible, according to this invention, to employ a magnetic sensor or other such arrangement. Thus the entire deflector 1 can pivot about the axis A through the arc indicated at 30 in FIG. 3, from a central position lying in a plane P including the axes A, A′ and A″. The deflector can pivot to either side of this central position lying in the plane P.

A controller 12 shown in detail in FIG. 4 is connected via a line 27 to the detector 13, via a line to the drive motor 15 for the detwister 5, via a line to a reversible drive motor 16 for the turntable 3, and via a line 29 to a generator 18 operated by the drive roller 11.

Assuming there is no twist in the strand S as it is pulled along the path from the supply 2 to the takeup roller 11 the deflector roller 17 will lie in the plane P. If the strand has S-twist the deflector 1 will be pivoted in one direction, and if it has Z-twist it will be pivoted in the opposite direction. The extent of deflection will depend largely on the pitch of the twist.

According to this invention the output signal from the detector 13 is fed via the line 27 as seen in FIG. 4 to an amplifier 31 and thence to an integrator 32 whose output is fed via line 41 to an adder 40 and to a differentiating circuit 33 having a pair of outputs connected via respective AND gates 34 and 35 to reversing relays 36 and 37 of a reversing circuit 50 connected to the motors 15 and 16. The sinusoidal output of the generator 18 will be fed via the line 29 to a pulse former 38 connected via a line 39 also to the adder 40 whose output is connected to the second inputs of the AND gates 34 and 35.

The output signal in the line 27 and at the output of the amplifier 31 will therefore vary up and down from a central level representing positioning of the roller 17 on the plane P. The integrator will produce an output which will increase with the deflection to one side and decrease with the deflection toward the other side and differentiating circuit 33 will translate this output into a binary signal either fed to the gate 34 or to the gate 35. In the event the deflection is to one side the gate 34 will have its one input energized and in the event the deflection is to the other side the gate 35 will have its one input energized. The gates 34 and 35 are never both energized by the circuit 33 at the same time and it is possible in the central position of the roller 17 for neither of their one inputs to be energized.

The sinusoidal wave form coming out of the generator 18 has a frequency directly proportional to the rotation rate of the takeup roller 11, which in turn is directly proportional to the conveying speed for the strand S. The pulse former 38 forms this sinusoidal wave form into a succession of pulses having the same size but spaced apart by distances determined by the frequency. These pulses are combined with the integrated output from the integrator 32 to produce a pulse output which has a pulse length dependent both on the speed of advance of the strand S and on the extent of deflection, growing in the event the speed increases or the deflection increases.

The controller 12 processes these signals, therefore, to rotate the detwisting device 5 in a direction exactly opposite to that of the twist sensed by the deflector 1. The turntable 3 is simultaneously operated for synchronous rotation in the same rotational sense as the supply 2, so that when a twist is sensed in the strand S this twist will automatically be eliminated. As the corrective action takes effect the output from the integrator 32 will decrease until either the differentiating circuit 33 will cease to energize either of the gates 34 and 35 so as to stop both of the motors 15 and 16, or at least the extent of deviation will decrease so that the pulses produced by the adder 40 will diminish in length.

The axis A is vertical and generally tangent to the guide surface formed by the periphery of the wheel 17 at a point 6 constituting the location at which the strand S enters into contact with the wheel 17. In this manner the torsional forces effective in the strand S due to its twist and longitudinal displacement will serve very effectively to rotate the entire deflector 1 about the axis A, so that the sensor 13 can give an output which exactly corresponds to the amount of twist in the strand S.

Thus the system according to the instant invention while operating very gently on the strand S is capable of untwisting it completely automatically and at high speed. The device operates wholly without supervision and can untwist badly randomly twisted textile webs, or only slightly twisted ones equally well. Relatively delicate fabrics can be handled with ease.

We claim:

1. An apparatus for detwisting a randomly twisted but flattenable textile web, said apparatus comprising:

a container adapted to hold a supply of said web;

an upstream guide adjacent said container and a downstream guide spaced from said upstream guide;

a deflector having a curved deflecting guide surface having a center or curvature and defining with said guides a path having a straight upstream leg between said surface and said upstream guide and a straight downstream leg between said surface and said downstream guide and misaligned with said upstream leg;

means downstream of said downstream guide for pulling said web from said supply along said path to pass sequentially through said upstream guide, over said surface, and through said downstream guide;

detwisting means along said upstream leg for twisting said web in said upstream leg about the longitudinal axis of said upstream leg in either rotational sense;

support means for said deflecting surface including a pivot defining an eccentric pivot axis for pivoting of said deflecting surface about said eccentric pivot axis from a center position in which said surface, said legs, and said pivot all generally lie in a plane, said pivot being spaced in said plane in said center position to the upstream side of a straight line equiangularly spaced between said legs and passing through said center of curvature, whereby any twist in said web where it engages said deflecting surface will pivot same from said center position about said pivot axis; and control means connected between said detwisting means and said support means for twisting said web in said upstream leg in response to pivoting of said deflecting surface from said center position in a rotational sense that detwists said web in said upstream leg and returns said surface to said center position.

2. The apparatus defined in claim 1 wherein said deflecting surface is the periphery of a wheel rotatable about an axis generally perpendicular to said plane.

3. The apparatus defined in claim 2 wherein said web lies on said periphery over an arc of contact starting at a point intersected by said pivot axis.

4. The apparatus defined in claim 2 wherein said deflector includes a support carrying said wheel and pivotal about said pivot axis, said control means including an indicating element carried on said support and means for detecting the position of said indicating element.

5. The apparatus defined in claim 1 wherein said detwisting means includes:

a support;

a plurality of rollers flanking said upstream leg and staggered therealong to form said web into a sinusoid; and means for rotating said support with said roller about the axis of said upstream leg.

6. The apparatus defined in claim 5 wherein said support also carries said deflector.

7. The apparatus defined in claim 1, further comprising a stabilizing wheel engaging said web in said upstream leg between said detwisting means and said deflector.

8. The apparatus defined in claim 1, further comprising means for rotating said container and supply synchronously and in the same direction as the strand is detwisted by said detwisting means.

9. A method of detwisting a twisted textile web, said method comprising the steps of:

continuously withdrawing the web from a supply and passing said web longitudinally along a path and over a curved deflecting surface;

deflecting said web with said surface and thereby dividing said path into an upstream leg and a downstream leg that are out of alignment with each other;

supporting said deflecting surface for pivotal movement about a pivot axis passing through a pivot located to the upstream side of a straight line passing through the center of curvature of said surface and angularly equispaced between said legs, whereby twist in said web will pivotally deflect said surface;

detecting pivoting of said surface about said pivot axis; and detwisting said web in said upstream leg in response to the detected pivoting of said surface.

10. The method defined in claim 9 wherein said web is detwisted pulse-wise to an extend generally directly proportional to the amount of pivoting from a predetermined center position that is detected and the rate of advance of said web along said path.

* * * * *